US006176561B1

(12) United States Patent
Roels et al.

(10) Patent No.: US 6,176,561 B1
(45) Date of Patent: Jan. 23, 2001

(54) DESK ARRANGEMENT

(75) Inventors: Bryan Roels, Hamilton, MI (US); Chris Simmons, Federal Way, WA (US); Tim Fookes, Grandville; Bret Marschand, Grand Rapids, both of MI (US)

(73) Assignee: Haworth, Inc., Holland, MI (US)

( * ) Notice: Under 35 U.S.C. 154(b), the term of this patent shall be extended for 0 days.

(21) Appl. No.: 09/326,187

(22) Filed: Jun. 4, 1999

(51) Int. Cl.[7] ..... A47B 81/00

(52) U.S. Cl. ..... 312/223.6; 312/196; 312/111; 108/50.02

(58) Field of Search ..... 312/223.6, 223.3, 312/223.1, 194, 195, 196, 111; 108/50.01, 50.02; 52/220.7, 290, 287.1, 288.1

(56) References Cited

U.S. PATENT DOCUMENTS

| | | | | |
|---|---|---|---|---|
| D. 309,839 | | 8/1990 | Newhouse . | |
| D. 311,833 | | 11/1990 | Newhouse . | |
| 3,446,544 | * | 5/1969 | Serwer | 312/111 |
| 3,748,006 | | 7/1973 | Levit . | |
| 3,883,202 | * | 5/1975 | Konig | 312/223.6 |
| 4,422,385 | | 12/1983 | Rutsche . | |
| 4,536,044 | * | 8/1985 | Ziegelheim et al. | 312/111 X |
| 4,637,666 | | 1/1987 | Worrell . | |
| 4,762,072 | * | 8/1988 | Boundy et al. | 312/194 X |
| 4,948,205 | | 8/1990 | Kelley . | |
| 4,974,913 | | 12/1990 | Vogt . | |
| 5,024,167 | | 6/1991 | Hayward . | |
| 5,071,204 | * | 12/1991 | Price et al. | 312/223.3 X |
| 5,092,253 | | 3/1992 | Grund . | |
| 5,094,174 | | 3/1992 | Grund . | |
| 5,103,741 | | 4/1992 | Grund . | |
| 5,121,698 | | 6/1992 | Kelley . | |
| 5,160,188 | | 11/1992 | Rorke . | |
| 5,183,319 | | 2/1993 | Pearson . | |
| 5,220,871 | | 6/1993 | Grund . | |
| 5,225,170 | | 7/1993 | Kolk . | |
| 5,226,705 | * | 7/1993 | Rorke et al. | 312/223.6 X |
| 5,237,935 | * | 8/1993 | Newhouse et al. | 312/223.6 X |
| 5,255,478 | * | 10/1993 | Baranowski et al. | 312/111 X |
| 5,429,431 | | 7/1995 | Olson . | |
| 5,451,101 | * | 9/1995 | Ellison et al. | 312/223.6 |
| 5,473,994 | | 12/1995 | Foley . | |
| 5,486,042 | | 1/1996 | Heisler . | |
| 5,568,773 | | 10/1996 | Hung . | |
| 5,606,920 | | 3/1997 | Meyer . | |
| 5,753,855 | * | 5/1998 | Nicoli et al. | 52/287.1 X |
| 5,833,332 | * | 11/1998 | Marshall et al. | 312/223.6 X |

* cited by examiner

*Primary Examiner*—Peter M. Cuomo
*Assistant Examiner*—Hanh V. Tran
(74) *Attorney, Agent, or Firm*—Flynn, Thiel, Boutell & Tanis, P.C.

(57) ABSTRACT

A desk or worksurface arrangement is provided which has a cable management slot along a back edge of the worksurface wherein removable end caps enclose the opposite ends of the slot. The caps retain cabling within the cable management slot but are removable without tools to permit the cabling to be slid out of the slot or past horizontally to an adjacent desk. The end caps may also be fixedly attached to a vertical storage unit to connect the vertical storage unit to the top of the desk arrangement while permitting the vertical storage unit to be removed from the desk without requiring tools.

20 Claims, 9 Drawing Sheets

DESK ARRANGEMENT

FIELD OF THE INVENTION

The invention relates to a desk arrangement, and more particularly, to a desk arrangement which accommodates cabling therein.

BACKGROUND OF THE INVENTION

Office areas frequently include desks or other worksurface arrangements which have cable management capabilities. For example, such desks often are provided with horizontal cable troughs and channels disposed below a worksurface to accommodate cabling therein such as for office equipment located on the worksurface. Such cable troughs and channels permit communication and power cabling to be routed horizontally through each desk and if desired, to adjacent desks or other furniture components.

Desks also may include slots and cable ports which allow cabling to be routed vertically from the troughs and channels to the worksurface so as to be connected to conventional office equipment such as modems, computers, telephones or the like. It also is known to provide support structures along the back edge of a worksurface to support office equipment, storage racks, storage rails and the like to for supporting additional office components such as document trays.

In a number of known desks, however, it may be difficult to reroute cabling between two adjoining desks and also route cabling vertically to the worksurface since the arrangement of the worksurface and desk components can interfere with the laying of the cabling. Desk arrangements also may have vertical storage units over the worksurface, which further complicates the routing of cabling since such units may be difficult to move.

It is an object of the invention therefore to eliminate a number of the disadvantages associated with such known systems.

The invention relates to a desk or worksurface arrangement which readily facilitates the laying of cabling both horizontally and vertically within a particular desk and further facilitates routing of such cabling between adjoining desks. The desk arrangement of the invention includes a worksurface having a cable management slot along a back edge thereof wherein the cable management slot allows cabling to be routed over the back edge of the worksurface to the cable channels disposed below the worksurface. The opposite ends of the cable management slot are enclosed by removable end caps, which confine vertical cabling sidewardly within the slot between the end caps, or vertically within open ends of the cable channels.

By removing the end caps, however, a horizontally elongate opening is defined which extends the entire length of the desk, which thereby permits horizontal lengths of cabling to be dropped or laid directly into one of the cable troughs. If two of the desks are adjoining each other, respective end caps are typically disposed next to each other wherein removal of the adjacent end caps permits cabling to be laid along a run of cable channels without requiring movement of the desks. The end caps are joined to the worksurface by a tongue and groove connection which does not require separate fasteners, much less tools for the connection of the end cap to the worksurface.

Further, the end cap also serves as a connector for a vertical storage unit wherein fasteners are inserted through the end cap vertically into a stile of the vertical storage unit. As a result, the end cap is fixedly attached to the stile and is movable therewith. When the end cap is engaged with the worksurface, the vertical storage unit is fixedly secured to the desk without any additional fasteners being required for the connection between the end cap and the worksurface.

The desk/worksurface arrangement of the invention thereby provides improved cable management capabilities, and also provides a connection between a vertical storage unit and a desk, which does not require tools for removal of the vertical storage unit therefrom.

Other objects and purposes of the invention, and variation and s thereof, will be apparent upon reading the following specification and inspecting the accompanying drawings.

Figure 1:
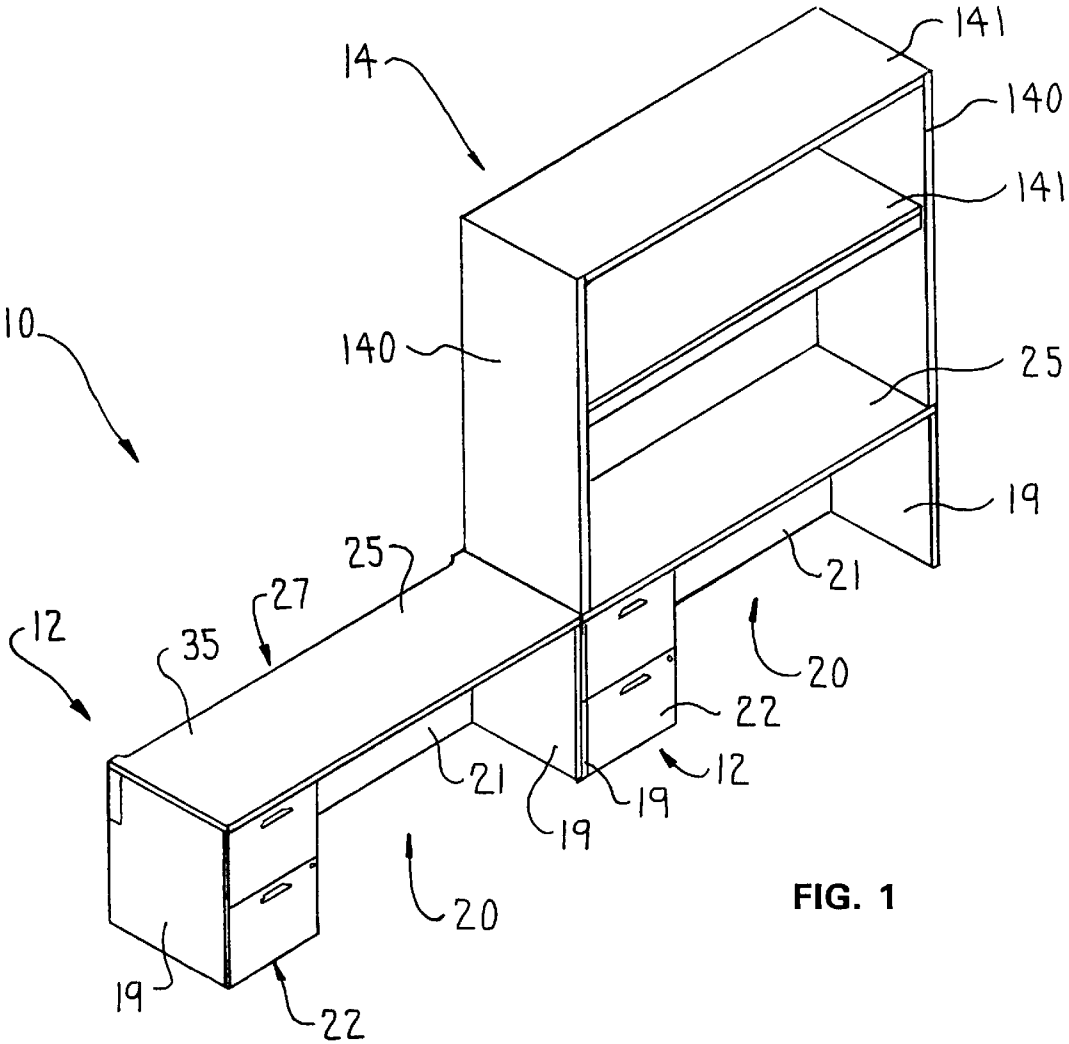
FIG. 1 is a perspective view of an arrangement of a desks.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the invention and designated parts thereof. Said terminology will include the words specifically mentioned, derivatives thereof, and words of similar import.

DETAILED DESCRIPTION

Figure 2:
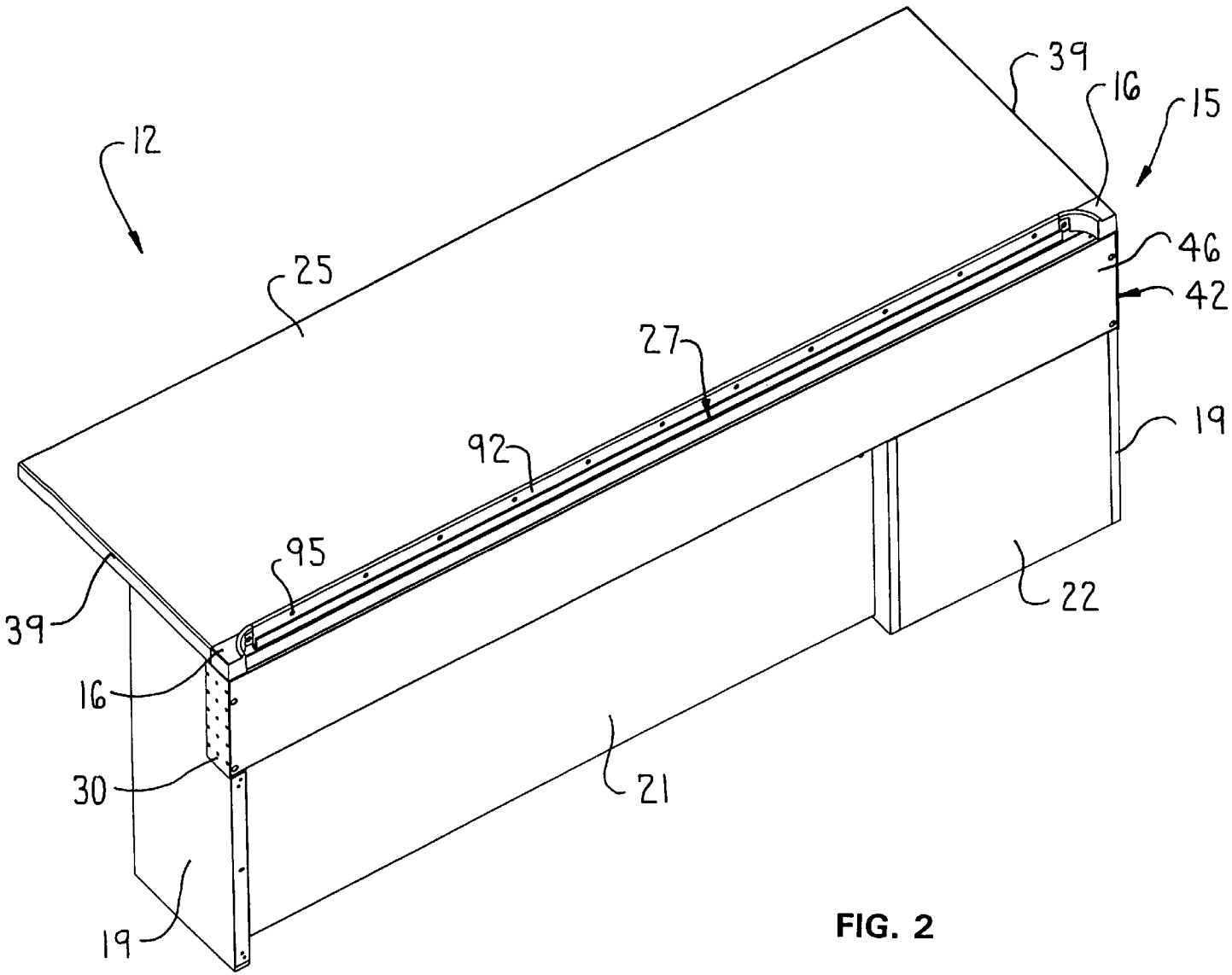
FIG. 2 is a rear perspective view of one of the desks.

Referring to FIGS. 1 and 2, the invention relates to a desk arrangement 10 which includes one or more desk or worksurface units 12 wherein any or all of the desk units 12 may have a vertical storage unit 14 mounted thereon. Each desk unit 12 includes a cable management slot arrangement 15 on the back edge thereof wherein the slot arrangement 15 includes removable end caps 16 which facilitate cable management and serve as connectors for the vertical storage unit 14.

Generally, each desk unit 12 typically includes end panels 19, which are disposed in load bearing engagement with the floor and are laterally spaced apart from each other to define a knee space 20 therebetween. The knee space 20 preferably is enclosed on an outer side thereof by a modesty panel 21, which extends laterally between the end panels 19. The desk units 12 are adapted to receive cabling therein as will be discussed in further detail hereinafter and also may include a storage unit 22 such as a file cabinet.

Each desk unit 12 of the invention further includes a worksurface 25 which is horizontally enlarged and overlies the knee space 20. The worksurface 25 is supported by the end panels 19 to define an upward facing surface upon which various electrical and communication equipment such as a receptacle unit 26 (FIG. 7) may be used.

Figure 3:
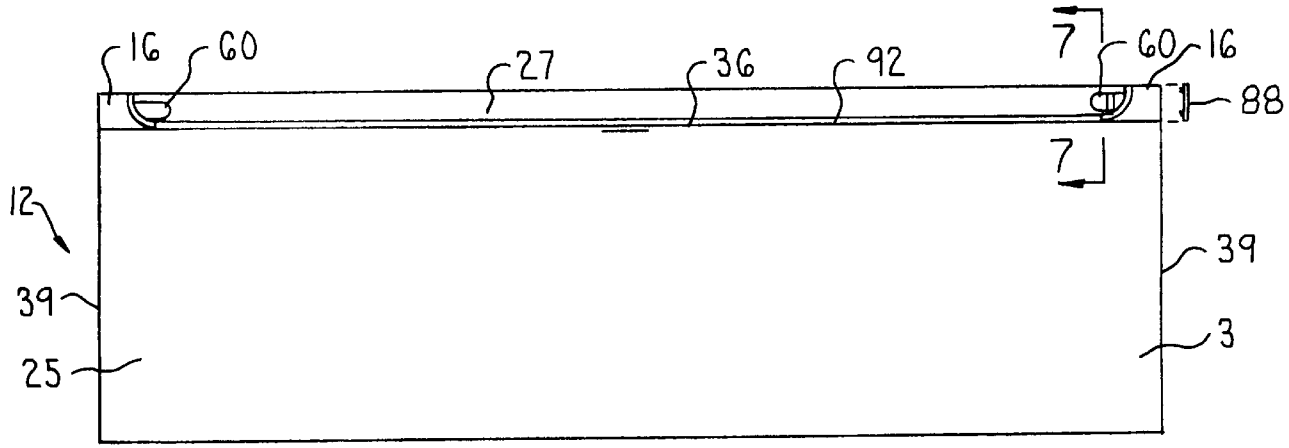
FIG. 3 is a plan view of the desk illustrating a cable management slot and toolbar along a back edge thereof.

The worksurface 25 also includes the slot arrangement 15 for routing cabling vertically, which said slot arrangement 15 includes a horizontally elongate slot 27 extending longitudinally along the back edge of the worksurface 25. The end caps 16 as illustrated in FIGS. 2 and 3 enclose the opposite ends of the slot 27.

Figure 5:
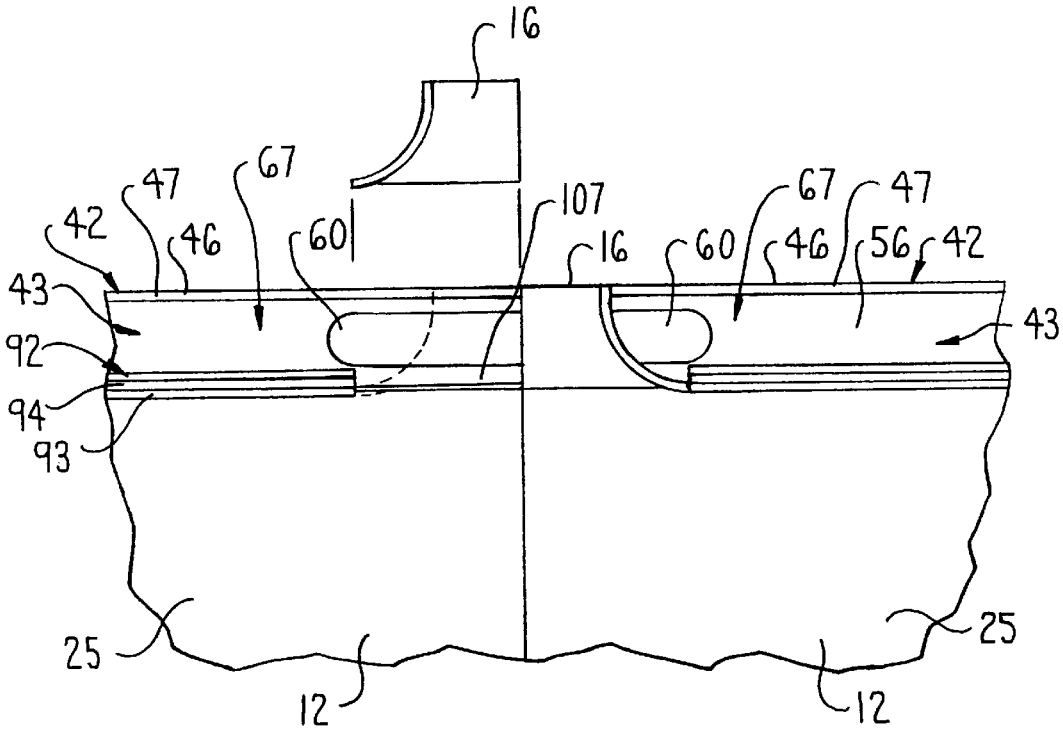
FIG. 5 is an enlarged plan view of two adjoining desks illustrating an end cap removed therefrom.

Generally, the slot 27 is provided to allow cabling to be routed vertically from the area of the knee space 20 to the top side of the worksurface 25 so as to supply communication and/or power connections to conventional office equipment. Since the end caps 16 are removable, the open area of the slot 27 may be extended horizontally out to the outermost side edges of the worksurface 25 so that cabling, which, for example, spans the entire length of the desk, may be laid downwardly through the slot without having to fish the cabling through discrete openings. When two desk units 12 are provided side-by-side as illustrated in FIG. 5, the slot 27 of one of the desk units 12 may be disposed in sideward communication with an adjacent slot 27 of the adjoining desk unit 12 so that the cabling may be readily laid along a row of desks 12.

Figure 6:
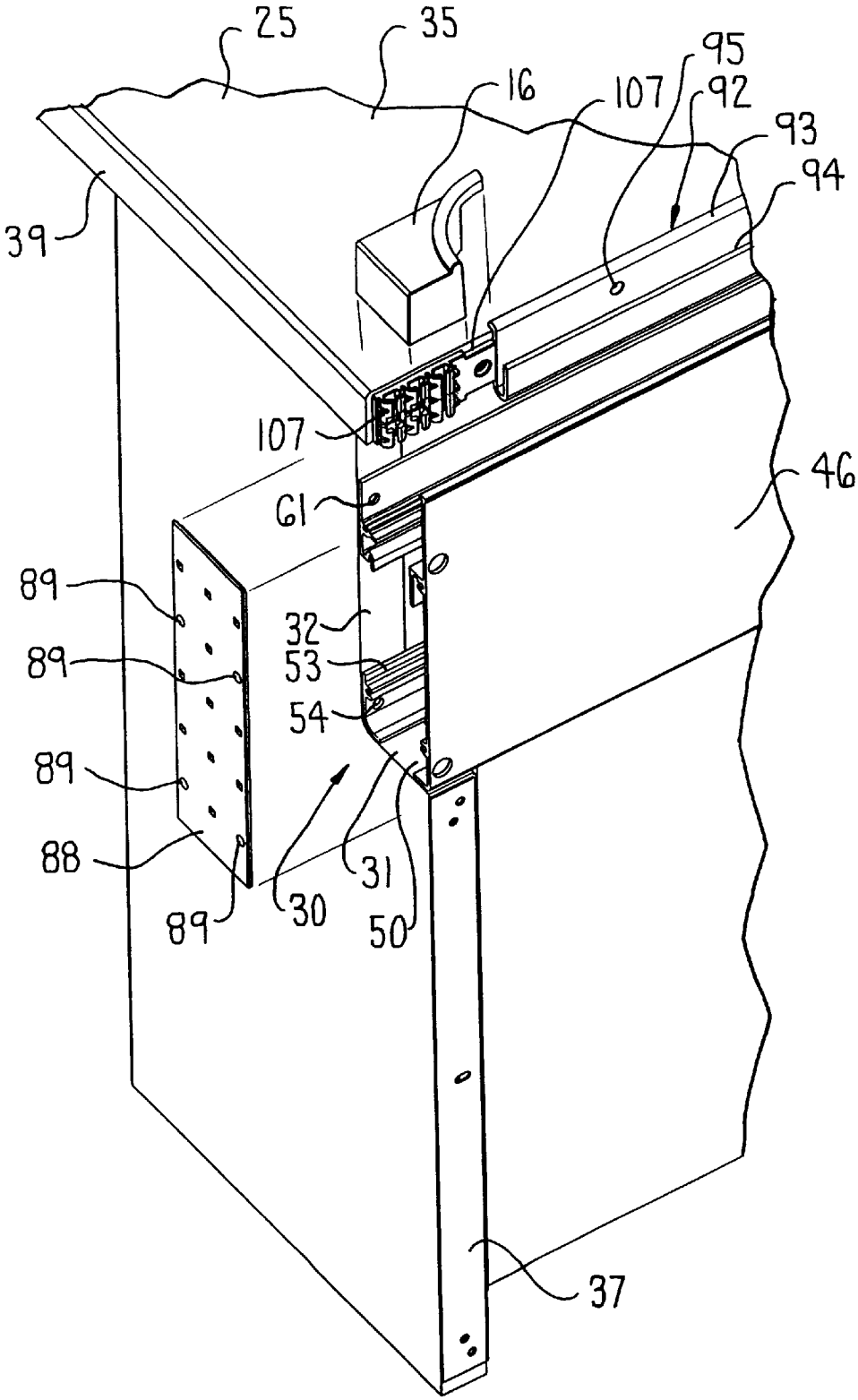
FIG. 6 is an exploded partial perspective view of the back corner of the desk.
Figure 7:
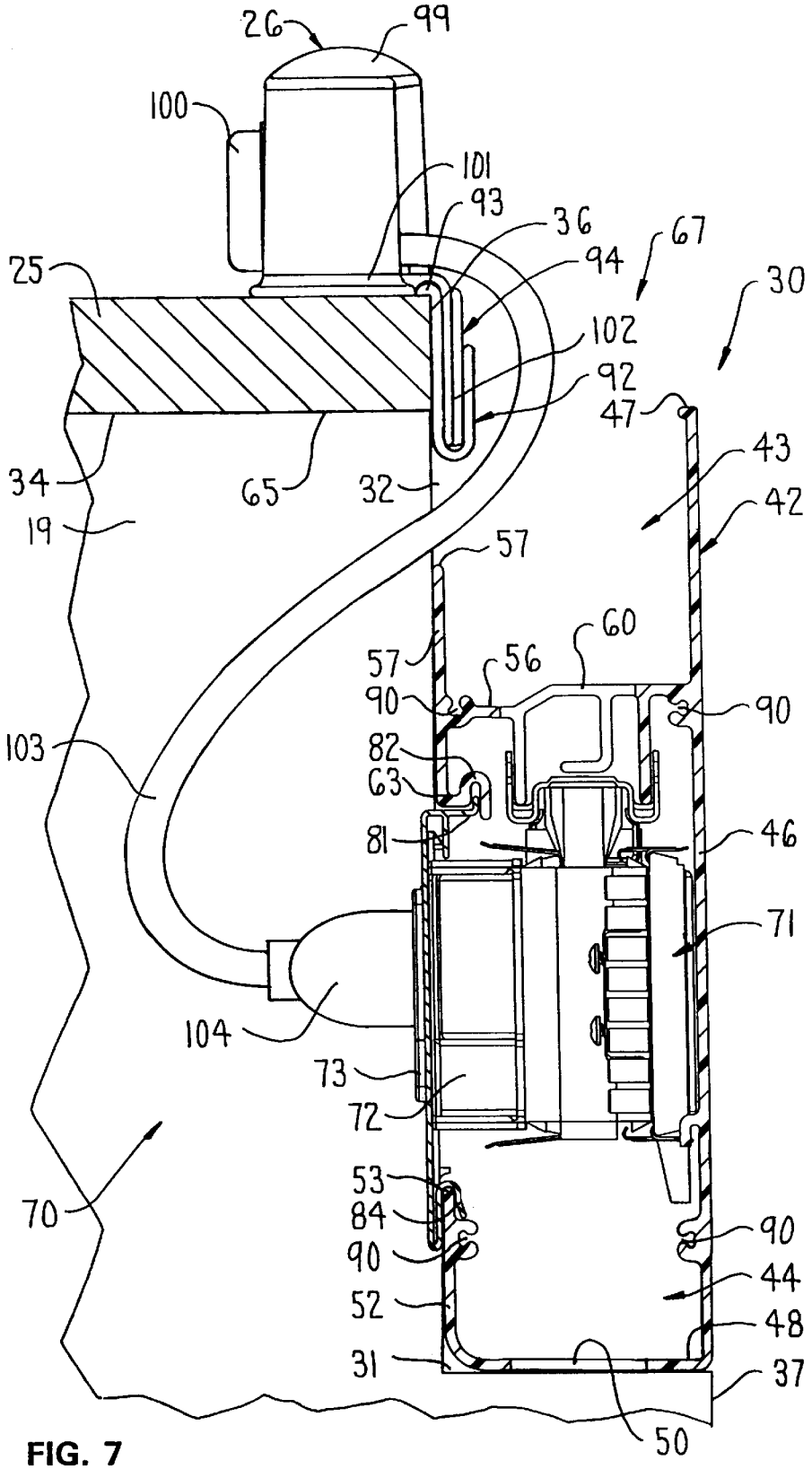
FIG. 7 is a side elevational view in cross-section of a cable management channel and slot arrangement as take along a line 7—7 of FIG. 3.

Referring more particularly to the components of the desk unit 12, each end panel 19 has a generally rectangular shape wherein a rectangular notch 30 is formed in the upper rear corner thereof. The notch 30 is bounded by a lower edge 31 and a front edge 32, but is open on the rear and upper sides as illustrated in FIGS. 6 and 7. The notch 30 defines an access opening, which opens sidewardly to allow cabling to extend horizontally into and along the desk unit 12 below the level of the worksurface 25. Upper edges 34 of the end panels 19 vertically support the worksurface 25 thereon.

One end panel 19 may be formed as part of a storage cabinet 22 or be disposed directly adjacent to the cabinet 22. The storage cabinet 22 is for the most part conventional although the cabinet 22 includes a notch along its rear upper corner similar to the end panels 19 as generally illustrated in FIG. 2.

Referring to FIG. 3, the worksurface 25 defines an upward facing support surface 35, and is rigidly attached to the end panels 19. The worksurface 25 has a rectangular, laterally elongate shape wherein a rear edge 36 of the worksurface 25 is aligned vertically with the front notch edge 32 as illustrated in FIG. 7. As a result, the rear worksurface edge 36 is spaced forwardly of a rear edge 37 of the end panel 19 to define the horizontally elongate slot 27 which extends the entire lateral length of the desk unit 12. In particular, the slot 27 extends laterally between the opposite side edges 39 of the worksurface 25 as illustrated in FIG. 3 and opens vertically to provide access to the area disposed below the worksurface 25.

Referring to FIGS. 2, 6 and 7, the desk unit 12 further includes a horizontally elongate channel unit 42 which extends the lateral length of the desk and defines upper and lower cable management channels 43 and 44 (FIG. 7). The channel unit 42 is preferably formed of an extruded material such as aluminum and has opposite left and right ends supported by the notches 30 of the end panels 19.

More particularly, the channel unit 42 includes a vertically enlarged back wall 46 which faces rearwardly and defines a vertical extension of the back edges 37 of the end panels 19. The back wall 46 closes off the open rear side of the notches 30 as seen in FIG. 2, and terminates in an upper lip 47 which is disposed approximately at the same elevation as the upper end panel edge 34.

The channel unit 42 further includes a bottom wall 48 which is vertically supported on the lower edges 31 of the notches 30. To facilitate the passage of cabling vertically through the bottom wall 48, the opposite ends of the bottom wall include elongate cable ports 50 which open vertically therethrough.

A lower front wall 52 projects upwardly from the bottom wall 48 a short distance and terminates at an upper edge 53. The lower front wall 52 faces forwardly and lies against the front edge 32 of the notch 30 and is fastened thereto by a fastener 54 (FIG. 6).

The channel unit 42 further includes an upward facing intermediate wall 56 and an upper front wall 57 wherein the intermediate wall 56 extends horizontally between the upper front wall 57 and the back wall 46. To permit cables to pass vertically through the intermediate wall 56, additional elongate cable ports 60 are formed in the opposite ends thereof as illustrated in FIGS. 5 and 7.

The upper front wall 57 is fastened to the front notch edge 32 by fasteners 61. This arrangement thereby defines the upper and lower cable channels 43 and 44 which extend along the horizontal length of the desk unit 12. The upper and lower channels 43 and 44 open sidewardly from their opposite ends to permit cabling to pass horizontally therethrough, for example, from one desk unit to an adjoining desk unit as generally illustrated in FIG. 5. Further, the cable ports 50 and 60 permit cabling to be routed vertically from one channel to another.

Still further, the upper and lower channels 43 and 44 are open on the front sides thereof as illustrated in FIG. 7 to permit cabling to be routed into and out of the channels 43 and 44 and over the upper front wall 57. More particularly, a lower edge 63 of the upper front wall 57 is spaced vertically from the upper edge 53 of the lower front wall 52. The lower channel 44 thereby is open along its entire front side.

Also, an upper edge 64 of the upper front wall 57 is spaced vertically downwardly from a bottom surface 65 of the worksurface 25. Accordingly, the upper channel 43 also is open on a front side thereof along its entire longitudinal length. Additionally, the upper lip 47 of the back wall 46 is spaced rearwardly of the back worksurface edge 36 such that an open upper side 67 is defined therebetween to permit cables to be laid vertically into the upper channel 43, or else, permit the cabling to be routed through the open front side of the upper channel 43 to the area disposed below the worksurface 25.

The desk unit 12 thereby is able to accommodate various types of cabling therein. For example as illustrated in FIGS. 4 and 7, a cabling systems 70 may be provided.

More particularly, the cabling system 70 includes a power distribution assembly 71 (PDA) of a conventional construction wherein the PDA 71 is suspended from the intermediate wall 56 (FIG. 7). The PDA 71 includes a plug-in receptacle unit 72 which faces forwardly and includes a front base plate 73 which permits access to conventional three-prong outlets as illustrated in FIG. 4. The cabling system 70 is laid into the lower channel 44 and is connected to exterior cabling 75 which then is connected to a power supply 76 at a junction 77. The cabling system 70 is covered by a channel cover 80 which is vertically enlarged and overlies the open front side of the lower channel 44.

Referring to FIG. 7, the channel cover 80 includes an upper flange 81 which engages a catch 82 formed on the upper front wall 57 and a lower U-shaped flange 84 which fits over the upper edge 53 of the lower front wall 52. The channel cover 80 thereby snaps into place and includes suitable openings or ports such that the receptacles 72 of the PDA 71 are accessible therethrough.

Figure 4:
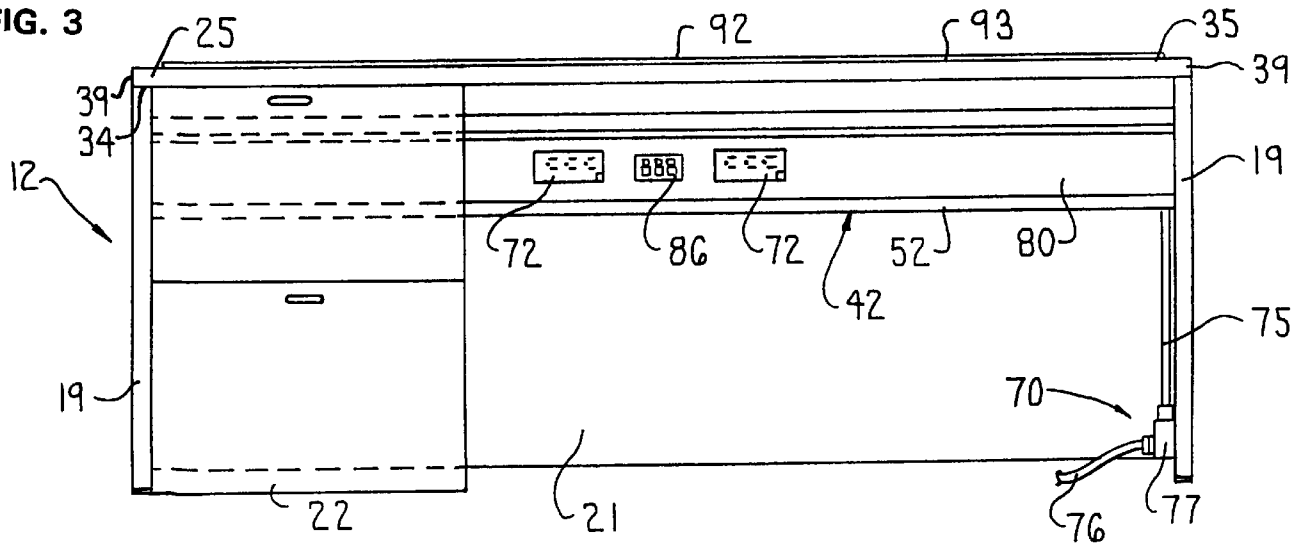
FIG. 4 is a front elevational view of the desk illustrating electrical and communication receptacles thereof.

The cabling system 70 also may include communication cabling which may be mounted in the channel unit 42, for example, into the lower channel 44 as illustrated in FIG. 4. The communication cabling comprises elongate cables and a receptacle 86 which is accessible forwardly through the channel cover 80.

Figure 15:
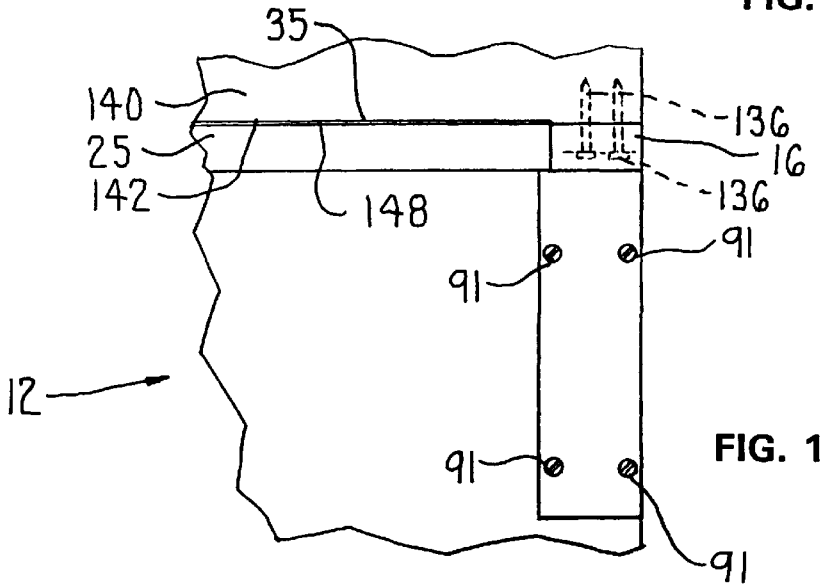
FIG. 15 is an enlarged end view of a connection between the desk and the vertical storage unit.

If the desk unit 12 is used as a stand alone unit or if the cabling is wholly contained within the desk unit 12, the channel unit 42 also may be provided with rectangular end covers 88 which are sized so as to enclose the notch 30. The end covers 88 as illustrated in FIGS. 6 and 15 are rectangular plates and have fastener holes 89 proximate the corners thereof.

To connect the end cover 88 to the ends of the channel unit 42, the opposite ends of the intermediate wall 56, the lower front wall 52 and the back wall 46 are provided with fastener slots 90 which are adapted to threadedly engage fasteners 91. In particular, the fasteners 91 (FIG. 15) are inserted through the fastener holes 89 and threaded into the corresponding fastener slots 90.

To facilitate mounting of further electrical components such as the receptacle unit 26 onto the worksurface 25, a toolbar 92 (FIGS. 2 and 7) is mounted to the rear worksurface edge 36. The toolbar 93 generally has a J-shape and includes an upper lip 93 which seats onto the upper surface 37 of the worksurface 25 to prevent pens and the like from falling into the slot 57. The toolbar 92 defines a horizontally elongate toolbar slot 94 which opens upwardly and is mounted to the rear worksurface edge 36 by fasteners 95.

The toolbar 92 is adapted to support various tools and office equipment. For example, the receptacle unit 26 of the invention includes a housing 99 that encloses a receptacle 100 which is accessible from the front face thereof. The housing 99 includes a base 101 which has a downwardly depending leg or flange 102 which fits downwardly into the toolbar slot 94 and is slidable horizontally therealong. This arrangement permits the receptacle unit 26 to be slid horizontally along the worksurface 25 to any desired location.

The receptacle unit 26 also includes an electrical cord 103 which extends into the upper channel 43 through the open upper side 67 thereof. The electrical cord is routed forwardly through the open front of the upper channel 43 and further includes a conventional three-prong plug 104 which is plugged into the receptacle 72 located in the lower cable channel 44.

When the end caps 16 are removed and the cable management slot 27 is fully exposed as generally illustrated in FIGS. 5, 6 and 7, the entire open upper side 67 of the upper channel 43 is accessible. This allows a horizontal length of cabling to be laid downwardly into the upper channel 43.

If two adjoining desks 12 are provided in side-by-side relation, the upper and lower channels 43 and 44 of the adjoining desks 12 are disposed directly next to each other and are in sideward communication with each other. This permits cabling, particularly cabling disposed in the upper channel 43, to be laid downwardly therein. This cabling may have a length which extends the entire width of two or more desks. Thus, when the upper channels 43 are fully open, the desks 12 need not be removed, for example, from next to a wall in order for the cabling to be laid into these channels 43. Further, cabling can be selectively routed from the upper or lower channels 43 and 44 to the top of the worksurface 25 as generally illustrated in FIG. 7.

Figure 8:
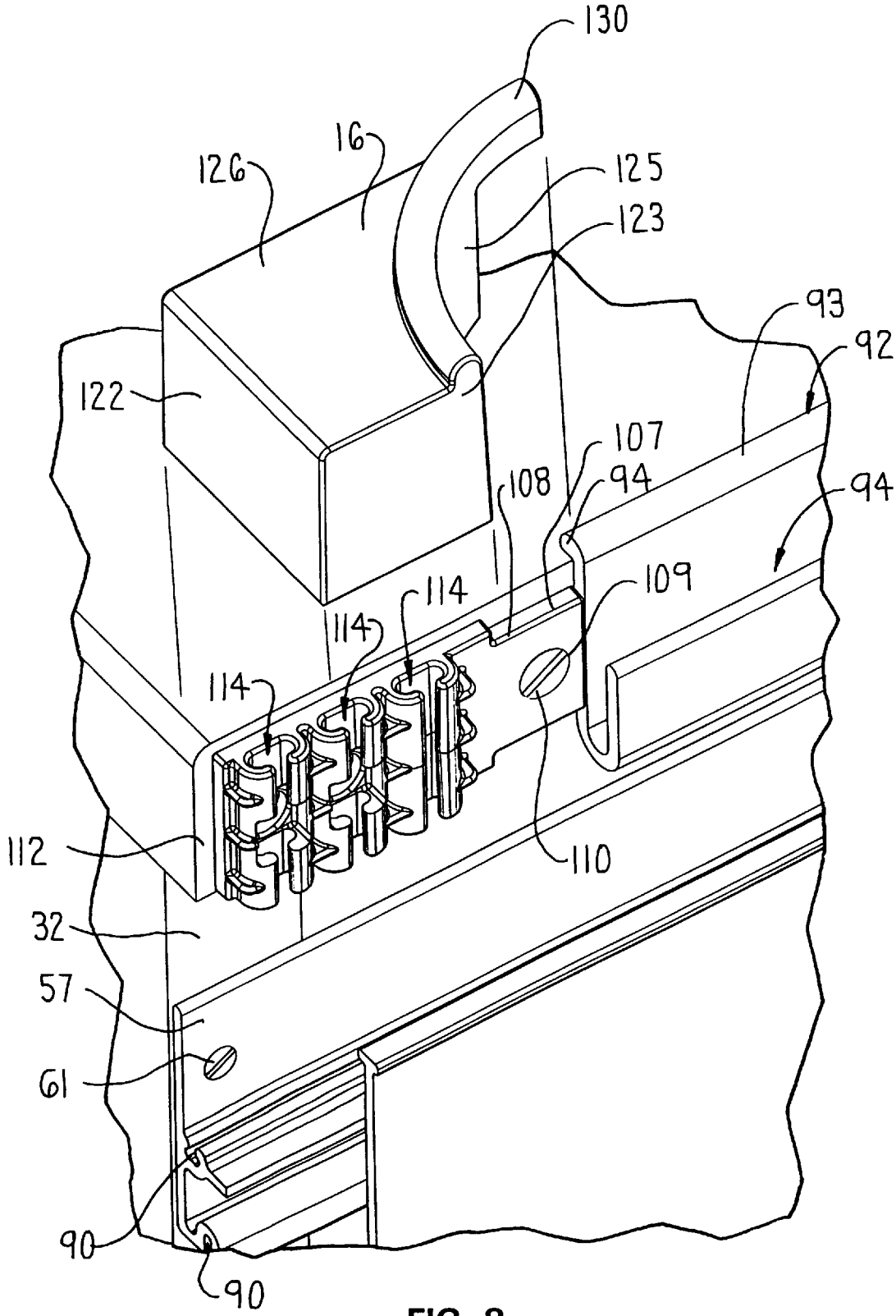
FIG. 8 is an exploded view of the end cap being removed from the desk.

Once the cabling is laid into the desk units 12, the aforementioned end caps 16 are fitted into the opposite ends of the slot 27. The end caps 16 cooperate with a plate-like connector 107 which is connected to the rear worksurface edge 36 as generally illustrated in FIG. 8.

Figure 9:
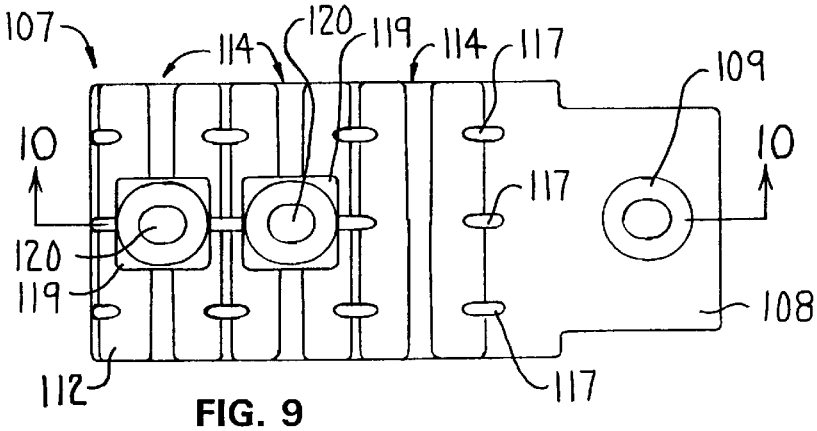
FIG. 9 is a front view of an end cap connector for mounting the end cap to the desk.

More particularly, the connector 107 (FIGS. 8, 9 and 10) includes a mounting section 108 at an inner end thereof which has a fastener hole 109 through which a fastener 110 is threadedly engaged with the rear worksurface edge 36. The connector 107 also includes a mounting section 112 at the opposite end thereof which defines a plurality of vertically elongate slots 114. The slots 114 open vertically from the upper and lower ends thereof to permit engagement with the end caps 16.

Figure 10:
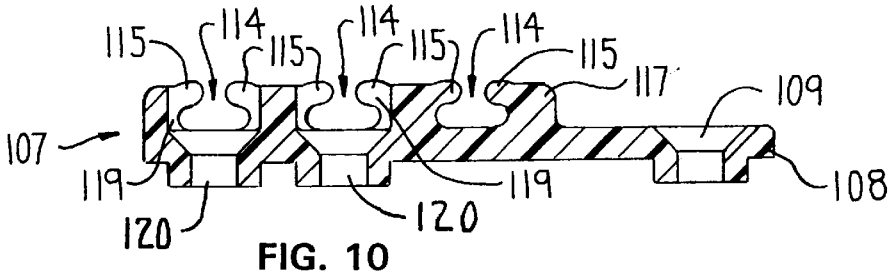
FIG. 10 is a cross-sectional view of the end cap connector as taken along aligned 11—11 of FIG. 10.

Arcuate side walls 115 define the slots 114 wherein each pair of side walls 115, which define a respective one of the slots 114, curve toward each other as generally illustrated in FIG. 10 but are laterally spaced apart to define a vertically elongate slot opening. The slot walls 115 further include wall braces 117 to limit deflection of the slot walls 115.

To further facilitate connection of the connector 107 to the rear worksurface edge 36, rectangular cutouts 119 are defined in the slot walls 115 of the two outermost slots 114 to provide access to two additional fastener holes 120. Respective fasteners are inserted through these holes 120 and threadedly engaged with the rear worksurface edge 36. Accordingly, a connector 107 is provided in each opposite end of the cable slot 27 wherein the connector 107 is disposed outwardly of the outermost end of the toolbar 92.

Referring to FIGS. 5, 8 and 11–13, each of the end caps 16 is adapted to be slid vertically downwardly into engagement with a corresponding one of the connectors 107. When the end cap 16 is mounted to the rear worksurface edge 36 as generally illustrated in FIG. 5, the end caps 16 serve to enclose off the outer ends of the slot 27. The end caps 16 thereby serve to confine cables horizontally within the slot 27 or vertically in the open ends of the channels 43 and 44.

More particularly, when the end caps 16 are secured in place, those cables which extend vertically between the top of the worksurface 25 and the channels 43 and 44 are confined laterally between a laterally spaced apart pair of end caps 16 which end caps 16 are located at the opposite ends of the slot 27. For those cables extending horizontally through the open ends of the channels 43 and 44, these cables are confined vertically between the bottom wall of the channel and the end caps 16 which overlie the channel.

Figure 11:
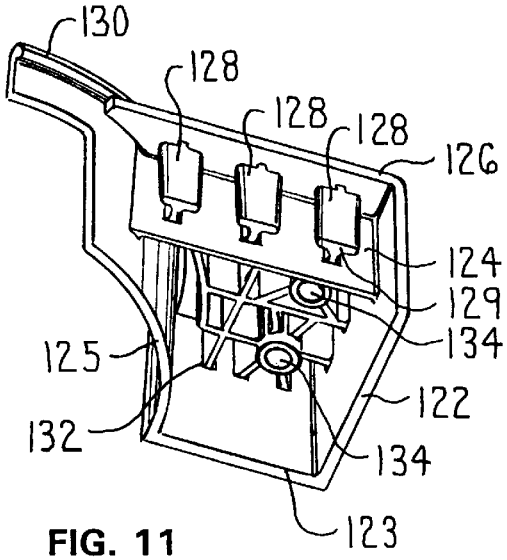
FIG. 11 is a bottom perspective view as taken from the rear of the end cap.
Figure 12:
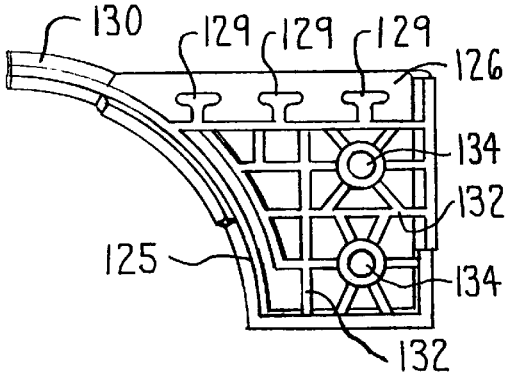
FIG. 12 is a bottom view of the end cap.
Figure 13:
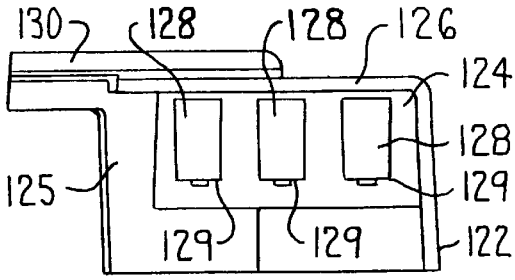
FIG. 13 is a rear elevational view of the end cap.

Referring to FIGS. 11–13, each of the end caps 16 generally includes an outer end wall 122, a rear wall 123, a front wall 124 and an arcuate wall 125. A top wall 126 overlies these side walls to define a block-like connector configuration.

To mount the end caps 16 to the worksurface 25, the front wall 124 thereof includes a plurality of T-shaped ribs or tongues 128 which extend upwardly and terminate at a bottom surface of the top wall 126. The ribs 128 are vertically elongate and the lower ends 129 thereof are adapted to slidably fit into the open upper ends of the slots 114 formed in the connectors 107. As such, each end cap 16 is fixedly secured to a corresponding connector 107 by sliding the lower rib ends 129 into the connector slots 114 until the top wall 126 abuts against the upper edge of the connector 107. The top wall 126 thereby prevents further downward insertion or sliding of the end cap 16. With this arrangement, the end cap 16 is freely slidable into engagement and in fact slides vertically downwardly into the cable slot 127 during assembly.

Thus, even if a desk unit 12 is pushed tight against a wall, the end caps 16 can be readily removed by sliding the end caps 16 upwardly. When an end cap 16 is mounted in place, the top wall 126 thereof is disposed substantially flush with the top of the worksurface 25 such that the end cap 16 defines a rearward projecting extension of the worksurface 25. Further, the arcuate wall 125 is aligned with and defines an arcuate extension of the toolbar 92 as illustrated in FIG. 3. Additionally, an arcuate rim 130 is provided along the upper edge of the arcuate wall 125 which arcuate rim 130 has the same shape and defines an arcuate extension of the upper lip 93 on the toolbar 92. The end caps 16 thereby blend in with and form extensions of the toolbar 92 and worksurface 25 even though the and caps 16 are readily removable.

To provide further rigidity to the end caps 16, a pattern of intersecting transverse ribs 132 are formed in the interior of the end caps 16 to strengthen the rear wall 123, front wall 124, arcuate wall 125 and top wall 126.

Besides being used to facilitate cable management, the end caps 16 also serve as connection blocks for the connection of a vertical storage unit 14 to the desk unit 12. As such, the end caps 16 include cylindrical fastener bores 134 which project vertically up to the lower surface of the top wall 126 but do not project therethrough. Thus, the fastener bores 134 are hidden and the end cap 16 has a continuous top wall 126.

When a vertical storage unit 14 is to be connected thereto, fasteners 136 (FIG. 15) are threaded upwardly into the fastener bores 134 until the tip ends thereof break through or pierce the top wall 126 and screw into the vertical storage unit 14 as will be described in further detail herein.

Figure 14:
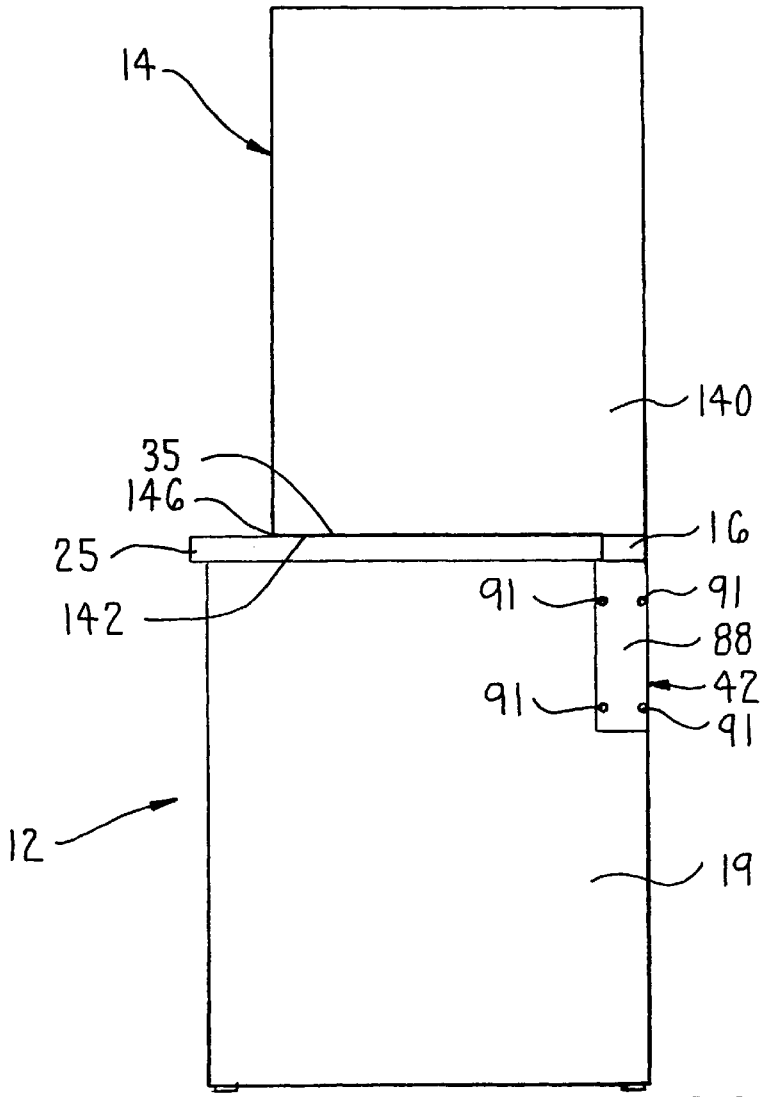
FIG. 14 is an end elevational view of the desk having a vertical storage unit disposed thereon.

More particularly with respect to the vertical storage unit 14, an exemplary vertical storage unit 14 is illustrated in FIGS. 1, 14 and 15 wherein the vertical storage unit 14 includes left and right stiles 140 which are laterally spaced apart. The stiles 140 support horizontal shelves or panels 141 which extend laterally therebetween. It will be appreciated that the stiles 140 may be used to support other cabinet constructions such as drawers, doors or the like.

The stiles 140 are vertically enlarged and have a substantial width in the front-to-back direction. The width is approximately the overall width of the desk unit 12 on which the vertical storage unit 14 is supported. To secure the vertical storage unit 14 to the desk 12, the end caps 16 are fastened to the stiles 140 wherein the end caps 16 and corresponding connector 107 provide a rigid connection therebetween.

More specifically, each stile 140 is provided with an end cap 16 which is threadedly engaged with a bottom stile edge 142 by the fasteners 136. The end cap 16 thereby projects downwardly, preferably from the rear corner of the stile 140. The bottom edge 142 has a substantial length such that the top of the worksurface 25 supports the vertical weight of the vertical storage unit 14. The primary function of the end caps 16 and connectors 107 is to prevent tipping of the vertical storage unit 14 upon the application of a transverse load directed in a forward direction.

When a forwardly directed tipping force is applied against the vertical storage unit 14 such as when a user pulls on the top thereof when opening a door or hanging onto the unit, the cooperation of the end cap ribs 132 in the connector slots 114 prevents the rear edge of the vertical storage unit 14 from being raised or lifted vertically. In particular, the slots 114 and ribs 132 bind when such a transverse load is applied thereto since the end caps 16 is not being pulled directly vertically but instead the vertical storage unit 14 effectively attempts to pivot about the front corner 146 thereof. Thus, when a tipping force is applied, the end cap 16 prevents the vertical storage unit 12 from toppling. To protect against unwanted play or minor movements of the vertical storage unit 12, an adhesive such as a double sided tape 148 may be applied between the opposing surfaces of the bottom stile edge 142 and the upper face of the worksurface 25.

With the above-described arrangement of the end cap 16, the desk units 12 have an improved cable management capability wherein cabling can be routed or re-routed simply by sliding the end caps 16 vertically from the slot 27. Further, the end caps 16 provide an improved connection method for connecting additional furniture components to the desk unit 12. In particular, end caps 16 can be readily threaded to a bottom edge, for example, of a vertical storage unit 14 and the vertical storage unit can be connected by sliding the end cap 16 downwardly into the corresponding connectors 107.

While the foregoing discussion primarily discloses a freestanding desk unit 12, it will be appreciated that other worksurface units may be provided. For example, while the desk unit includes a worksurface 25 supported on end panels 19, alternative types of support structure and worksurface supports may also be provided for the worksurface 25. In particular, a worksurface 25 could be supported by a central pedestal or supported on wall panels or the like and the worksurface 25 could still include the end caps 16.

Although particular embodiments of the invention have been disclosed in detail for illustrative purposes, it will be recognized that variations or modifications of the disclosed apparatus, including the rearrangement of parts, lie within the scope of the present invention.

What is claimed is:

1. A desk arrangement comprising:

a worksurface support which is disposed in load bearing engagement with a floor, said worksurface support including a cable channel which extends horizontally therethrough along a lateral length of the desk arrangement, said cable channel including opposite open ends which open horizontally from the opposite ends of the desk arrangement to permit cabling to enter and exit said cable channel through said open ends, said cable channel further including an open upper side along the longitudinal length of said cable channel which permits cabling to be laid vertically therein;

a horizontally enlarged worksurface which is vertically supported on said worksurface support in vertically spaced relation from the floor, said worksurface including a horizontally elongate slot which opens vertically through said worksurface and extends between opposite end edges of said worksurface, said slot opening downwardly into said open upper side of said cable channel to permit cabling to be laid vertically into said cable channel through said slot; and at least a pair of end caps which are insertable into said slot to enclose opposite ends of said slot, each of said end caps being disposed in said slot to confine vertical cabling within said slot and horizontal cabling within said cable channel, said end caps being removable to permit movement of said cabling upwardly from said cable channel or sidewardly from said slot.

2. A desk arrangement according to claim 1, wherein said end caps are insertable downwardly into said slot into engagement with said worksurface.

3. A desk arrangement according to claim 1, wherein said slot extends laterally along a back edge of said worksurface such that said slot is disposed vertically above said open upper side of said cable channel and said end caps project rearwardly from said back edge of said worksurface in cantilevered relation.

4. A desk arrangement according to claim 3, wherein said back edge of said worksurface is disposed forwardly of a back edge of said worksurface support.

5. A desk arrangement according to claim 4, wherein a horizontally elongate support rail is connected to said back edge of said worksurface adjacent to said slot, office equipment being provided in slidable engagement with said support rail so as to be horizontally slidable along said worksurface, said office equipment including cabling which extends vertically downwardly into said cable channel through said slot.

6. A desk arrangement according to claim 1, wherein cap connectors are mounted to an edge of said worksurface adjacent said slot, each said end cap being slidable downwardly into secure engagement with a corresponding one of said cap connectors.

7. A desk arrangement according to claim 6, wherein a connection is defined between each of said cap connectors and said end cap corresponding thereto which is free of separate fasteners.

8. A desk arrangement according to claim 7, wherein said desk arrangement includes a vertical storage unit which is supported on an upper side of said worksurface, said end caps being connected to opposite ends of said vertical storage unit and projecting downwardly therefrom wherein said vertical storage unit is connected to said worksurface by said fastener free connection defined between said end cap and said connector corresponding thereto.

9. A desk arrangement comprising:

a worksurface supported on a base, said worksurface being horizontally enlarged and including a mounting edge which extends laterally between opposite end edges of said worksurface, said mounting edge including a plurality of connectors secured thereto and having a corresponding plurality of connection blocks which are supported on said worksurface by said connectors, said connection blocks and said connectors being removably joined together by a slot and rib connection defined therebetween wherein said connection blocks are secured to said worksurface by downward sliding of said connection blocks vertically into engagement with said connectors; and a vertical cabinet unit which is supported on top of said worksurface, said vertical cabinet unit including a bottom edge supported on said worksurface and projecting upwardly therefrom, said connection blocks being connected to said bottom edges so as to project downwardly therefrom, said vertical storage unit being secured to said worksurface by downward sliding of said connection blocks into engagement with said corresponding connectors.

10. A desk arrangement according to claim 9, wherein said connection blocks and said connectors are defined by a plastic material, one of said connection blocks and said connectors including vertically elongate ribs and the other of said connection blocks and said connectors including vertically elongate slots which slidably receive said ribs therein to define said slot and rib connection.

11. A desk arrangement according to claim 10, wherein said vertical cabinet unit includes laterally spaced apart stiles which extend downwardly to define said bottom edges, said stiles including front edges which are spaced from said connector block in a first direction wherein said cooperating slots and ribs bind when a tipping force is applied to said vertical cabinet unit in said first direction.

12. A desk arrangement according to claim 11, wherein each said connection block is mounted to said bottom edge of said vertical cabinet unit proximate a lower corner thereof.

13. A desk arrangement according to claim 12, wherein said connection blocks are connected to said bottom edges by fasteners.

14. A desk arrangement according to claim 9, wherein said vertical cabinet unit includes laterally spaced apart stiles which extend downwardly to define said bottom edges, said stiles including front edges which are spaced from said connector block in a first direction wherein said cooperating slots and ribs bind when a tipping force is applied to said vertical cabinet unit in said first direction.

15. A desk arrangement according to claim 14, wherein said slots and ribs are disengagable when a vertical lifting force is applied to said vertical cabinet unit but are fixed together when a tipping force is applied to said vertical cabinet unit in a direction oriented generally parallel to said worksurface.

16. A desk arrangement comprising:

a worksurface supported on a base, said worksurface being horizontally enlarged and including a mounting edge which extends laterally between opposite end edges of said worksurface, said mounting edge including a plurality of connectors secured thereto and a corresponding plurality of connection blocks which are supported at said worksurface by said connectors, said connection blocks and said connectors being removably joined together by a fastener free connection which is free of separate independent fasteners therebetween; and a vertical cabinet unit which is supported on top of said worksurface, said vertical cabinet unit including a bottom edge supported on said worksurface and projecting upwardly therefrom, said connection blocks being connected to said bottom edge so as to project downwardly therefrom, said fastener free connection permitting said connection blocks to be moved vertically relative to said connectors to permit engagement and disengagement thereof wherein said vertical storage unit is secured to said worksurface by downward sliding of said connection blocks into engagement with said corresponding connectors, said fastener free connection preventing disengagement of said connection blocks and said connectors when a transverse force is applied to said vertical cabinet unit in a forward direction.

17. A desk arrangement according to claim 16, wherein said vertical cabinet unit includes a front edge disposed adjacent to said worksurface, said connection blocks being spaced rearwardly of said front edge.

18. A desk arrangement according to claim 17, wherein said front edge defines a pivot point about which said vertical storage unit tends to pivot when said transverse force is applied to said vertical cabinet unit, said connection blocks and said connectors preventing pivoting of said vertical storage unit about said pivot point.

19. A desk arrangement according to claim 16, wherein said fastener free connection is defined by cooperating slots and ribs which are vertically elongate.

20. A desk arrangement according to claim 16, wherein said connection blocks and said corresponding connectors are formed of plastic.

* * * * *